United States Patent [19]

Silverglate

[11] Patent Number: 5,030,157

[45] Date of Patent: Jul. 9, 1991

[54] FLYING TOY HAVING FLUID DISPLACEABLE BLADES

[76] Inventor: David E. Silverglate, 114 Tree Frog La., Santa Cruz, Calif. 95060

[21] Appl. No.: 416,727

[22] Filed: Oct. 3, 1989

Related U.S. Application Data

[60] Division of Ser. No. 324,986, Mar. 15, 1989, abandoned, which is a continuation of Ser. No. 11,145, Feb. 5, 1987, abandoned.

[51] Int. Cl.[5] ..... A63H 27/00

[52] U.S. Cl. ..... 446/48; 446/36

[58] Field of Search ..... 446/48, 36, 34, 217, 446/218; 273/425, 424; 415/141, 140; 416/195, 194, 135, 136, 140, 131, 132 B, 132 A, 132 R

[56] References Cited

U.S. PATENT DOCUMENTS

| | | | |
|---|---|---|---|
| 811,599 | 2/1906 | Turner | 446/217 |
| 2,035,531 | 3/1936 | Butcher | 446/43 |
| 2,931,132 | 4/1960 | Griessl | 446/36 |
| 3,742,643 | 7/1973 | Keith | 446/46 |
| 4,184,654 | 1/1980 | Herrera | 446/36 X |
| 4,185,826 | 1/1980 | Ueng | 273/424 |
| 4,203,249 | 5/1980 | Bohm | 446/48 |
| 4,425,734 | 1/1984 | Bauer | 446/48 |
| 4,506,894 | 3/1985 | Laux et al. | 273/425 |

*Primary Examiner*—Mickey Yu

*Attorney, Agent, or Firm*—Schroeder, Davis & Orliss Inc.

[57] ABSTRACT

A flying toy for use in short distance indoor or outdoor flight games involving a single player or many players includes a low mass, resilient peripheral tension ring, a lightweight flight surface and an inner ring and may be maintained in flight by repeated tangential strikes to impart additional rotational and translational speed. In an alternative embodiment, a bladed flying toy includes a central hub and deflectable radial blades which cause the toy to rotate in a predetermined direction when the toy is pushed upwards and which, upon release, cause the toy to rise and then fall slowly downwards in an autogyro fashion while continuing rotation in the same direction.

11 Claims, 5 Drawing Sheets

FLYING TOY HAVING FLUID DISPLACEABLE BLADES

CROSS REFERENCE TO RELATED APPLICATION

This application is a divisional application of U.S. patent application Ser. No. 07/324,986 filed on Mar. 15, 1989, now abandoned. Ser. No. 07/324,986 was a continuation of U.S. patent application Ser. No. 07/011,145 filed on Feb. 5, 1987, now abandoned.

BACKGROUND AND SUMMARY OF THE INVENTION

The recreational use of flying toys has long been enjoyed by both children and adults and many popular games involve the flying of such devices between two or more players. Often, the distance of the flight is a demonstration of the skill of the players.

The Frisbee flying disc, manufactured by the Wham-O Manufacturing Company and described in U.S. Pat. No. 3,359,678, is an example of a prior art recreational flying device. The Frisbee flying disc is a saucer shaped device suitable for relatively long flights between players. Substantial flight distances are possible because of the total mass, peripheral mass distribution and solid, rigid, construction of the flying disc which contribute to high angular momentum during flight. The Superflight, Inc., Aerobie flying ring, described in U.S. Pat. No. 4,560,358, is another prior art device and is specifically designed for recreational flying over great distances. Like the Frisbee flying disc, the Aerobie flying ring has a relatively high mass distributed around the periphery of the ring for high angular momentum.

While such prior art flying devices are well suited for high angular momentum, long horizontal flights they are poorly suited for flying games played over short distances. In such games, played either by a single player or by multiple players, the object is to maintain slow flight over a small horizontal distance. Such games are often played indoors with the attendant requirement for low velocities and short flights.

In accordance with an illustrated preferred embodiment of the present invention a flying toy includes a low mass, high spring constant, peripheral tension ring, a coaxial lightweight flight surface, and an inner ring. The flight surface, in tension between the peripheral and inner rings, provides an airfoil and the peripheral ring provides a non-rigid, deformable and resilient periphery. Due to its low mass the flying toy has a low angular momentum during flight and a player may easily prolong flight by repeatedly striking the flying toy in the direction of rotation. Because of the resiliency of the peripheral ring, the player's strikes restore rotational velocity and prolong flight without imparting appreciable horizontal momentum. Thus, the flying toy is well suited for single player maintainable flight and, because of its resiliency and light weight, is also suitable for indoor use. In addition, the deformability of the tension ring allows the toy to be folded in a twisting manner for ease of storage or transport in a minimum of space.

In accordance with another illustrated preferred embodiment of the present invention a flying toy well suited for use by a single player includes deflectable blades radially positioned about a central hub. During use, the player may catch the bladed flying toy within the hub and may then push the toy vertically to cause rotation in a predetermined direction. Upon release, the toy first floats upwards and then begins to float downward thereby causing the direction of air flow through the toy to reverse. Since the blades are deflectable, not fixed, the air flow reversal causes the blades to reverse and the new blade deflection causes the toy to continue rotating in the same direction. The toy then falls slowly in the manner of an autogyro and is easily caught and thrown again by the single player.

DETAILED DESCRIPTION OF THE PREFERRED EMBODIMENTS

Figure 1:
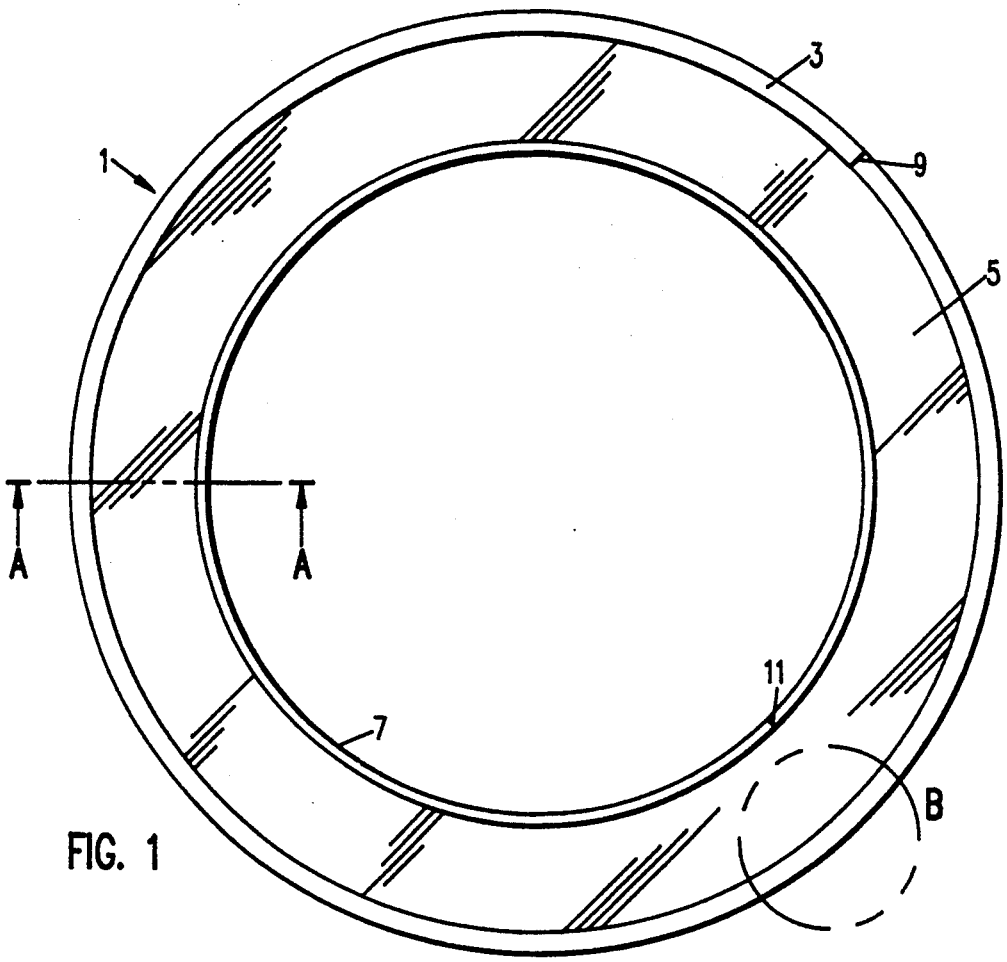
FIG. 1 shows a top view of a flying toy constructed in accordance with the preferred embodiment of the present invention.
Figure 2:
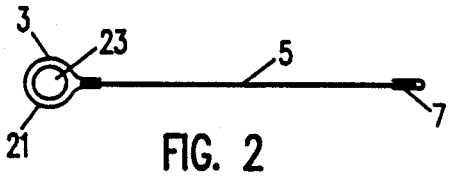
FIG. 2 shows a cross sectional view of the flying toy along lines A—A in FIG. 1.

FIG. 1 shows a flying toy 1 that is constructed in accordance with the preferred embodiment of the present invention. The flying toy 1 includes a peripheral tension ring 3, a flight surface 5 and an inner ring 11. FIG. 2 shows the details of the flying toy 1 as a cross-sectional view along lines A—A of FIG. 1. The tension ring 3 is fabricated from a circular stay 23 and a peripheral cover 21. The peripheral cover 21 is sewn to the flight surface 5 which is in turn sewn to the inner ring 7. The peripheral cover 21 may be made from any light weight, durable cloth such as two ounce Oxford cloth. For esthetic effects the peripheral cover 21 may be colored with a fluorescent dye or may be lettered with, e.g., a silk screen process.

As shown in FIGS. 1 and 2, the toy 1 is completely symmetrical and the circular stay 23 extends around the circumference of the toy 1 to provide shaping. The stay 23 must be made from a material that is capable of tensioning the flight surface 5 to provide an airfoil during flight. In addition, the stay 23 must be of a sufficiently low mass material that the toy 1 maintains a low angular momentum during flight and has a high overall surface area to weight ratio. Finally, it is important that the stay 23 be resilient and deformable and also have a relatively high spring constant. This combination ensures that strikes by the players deform the toy 1 while imparting rotational energy so that the toy 1 continues to rotate and does not travel excessively far from the players. In the preferred embodiment, the stay 23 is fabricated from an approximately fifty inch length of Nylaflow brand Type H plastic tubing having an inside diameter of 0.110 inch and an outside diameter of 3/16 inch.

The flight surface 5 is made from a material, such as two ounce Oxford cloth, that provides a lightweight and airtight airfoil. The inner ring 7 may be made from the same material as the flight surface 5 and is sewn around the inner edge of the flight surface 5 to provide stiffening and tensioning against the tension ring 3. If additional tension is desired, a closed loop of 0.010 inch diameter stainless steel wire may be placed inside the inner ring 7.

The first step in the fabrication of the toy 1 is to finish the flight surface 5 as a ring or two joined half-rings of material. In the preferred embodiment, the flight surface 5 is two inches in width and has an outer diameter of 16 inches. The dimensions may be varied as desired, e.g., to compensate for a smaller diameter toy 1. A stiffer inner ring 7 may be used to increase tension and to lessen drag during flight if an excessive width is used. The inner ring 7 is then cut as a strip of material ½ inch wide by 44 inches long and is folded over and sewn to the inner edge of the flight surface 5. A wire loop may be placed within inner ring 7 for extra tension. The stay 23 is then formed into a circle and is attached to the flight surface 5 by sewing the approximately fifty inch by one inch peripheral cover over the stay 23 to the flight surface 5. Care must be taken to ensure that the stay 23 provides correct tensioning of the flight surface 5.

Figure 3:
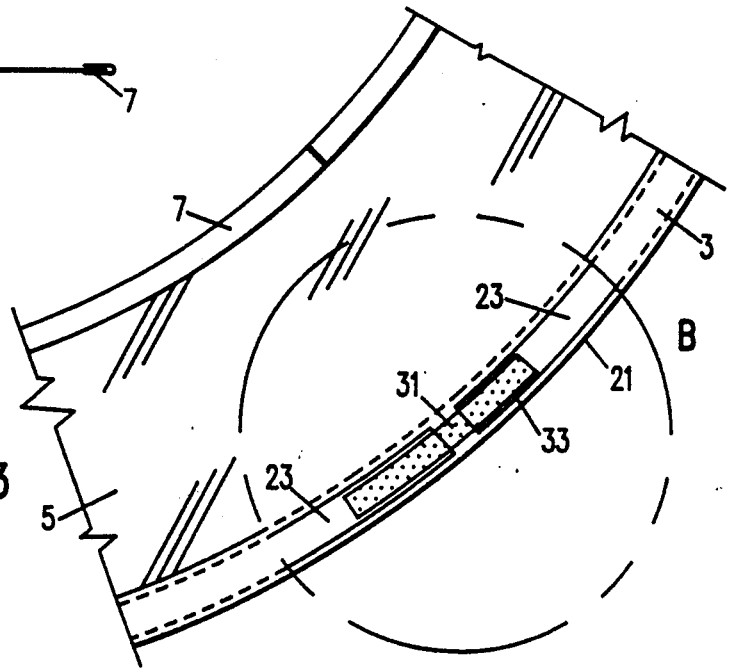
FIG. 3 shows an exposed view of portion B of the flying toy shown in FIG. 1.

FIG. 3 shows a detail cut-away view of the tension ring 3 shown in FIG. 1. The circular stay 23 may be fashioned most easily as a single length of tubing lying within the peripheral cover 21. The ends of the circular stay 23 may be connected together by welding or gluing. If appreciable deformation of the toy is expected, as, for example, during folding to minimize storage space, then the abutting ends of the circular stay 23 should be connected to form a swivel connection as discussed below.

FIGS. 4A–4D show the steps involved in folding the toy 1 into a smaller shape for easy storage and transport that is advantageous during, e.g., backpacking expeditions. The toy 1 is folded in a figure-8 fashion to form two loops 41 and 43. The top loop 41 is then folded over the bottom loop 43 to form the half sized storage shape shown in FIG. 4D. Triple fold techniques of the same nature may also be used. In order for the toy 1 to be useable and undeformed after folding and unfolding, it is important that the circular stay 23 not kink within the cover 21.

Figure 4A:
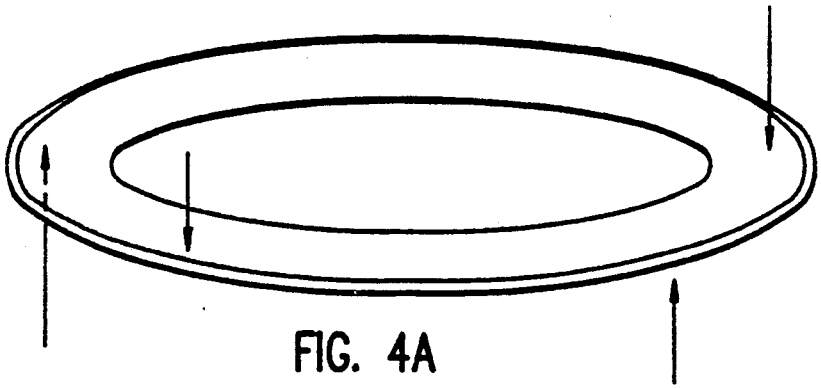
FIGS. 4A-4D show the steps performed in folding the flying toy shown in FIG. 1.
Figure 4B:
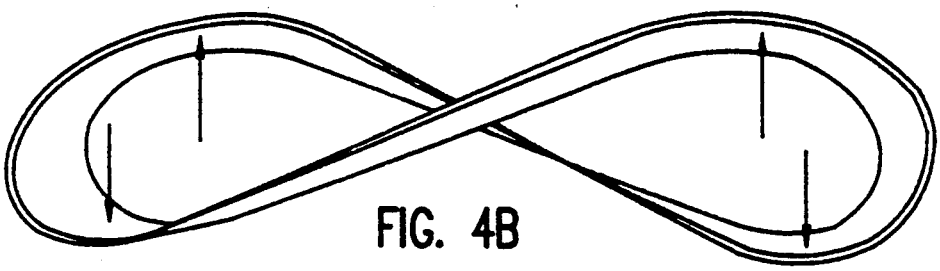
Figure 4C:
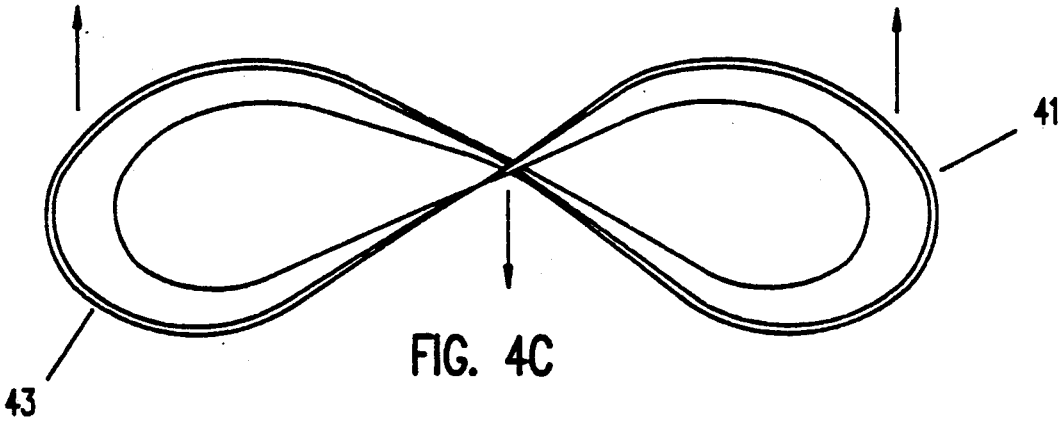
Figure 4D:
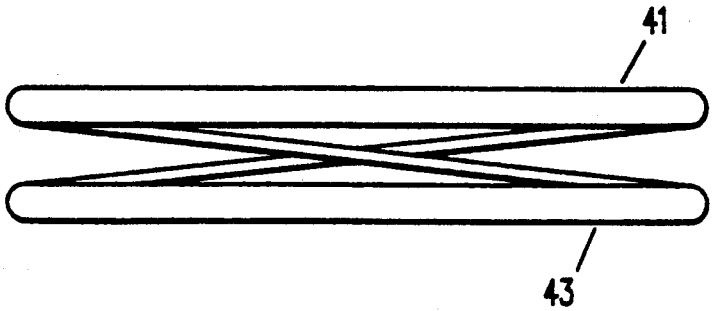

Kinking of the stay 23 may be avoided by coupling together the abutting ends of the stay 23 to form a swivel connection as shown in FIG. 3. A coupler 31, fabricated from a ¾ inch length of 3/32 inch outside diameter spring steel (or a 3/32 inch outside diameter roll pin), is inserted within the ends of the stay 23. Since neither end of the stay 23 is securely fastened to the coupler 32, the ends are free to rotate about the coupler 31 as the toy 1 is folded or otherwise deformed as shown in FIGS. 4B–4D. When the toy 1 is returned to the shape shown in FIG. 4A, the ends of stay 23 may easily be rotated as desired about the coupler 41 to re-establish the desired shape.

In order to avoid slippage of the coupler 31 out of one or the other of the ends of the stay 23, it may be desirable to restrict the travel of the coupler 31. This restriction may be accomplished by fastening one end of the coupler 31 to the stay 23 with an adhesive 33 such as Eastman 910, or another adhesive or mechanical fastener, s shown in FIG. 3. Alternatively, one or both ends of the coupler 31 may be restricted from travelling within stay 23 by insertion of a plug or plugs (not shown) into the interior of the stay 23. In this fashion, the stay 23 remains free to rotate relative to the coupler 31 and the coupler 31 is restricted from slipping away from contact with the ends of the stay 23.

Figure 5:
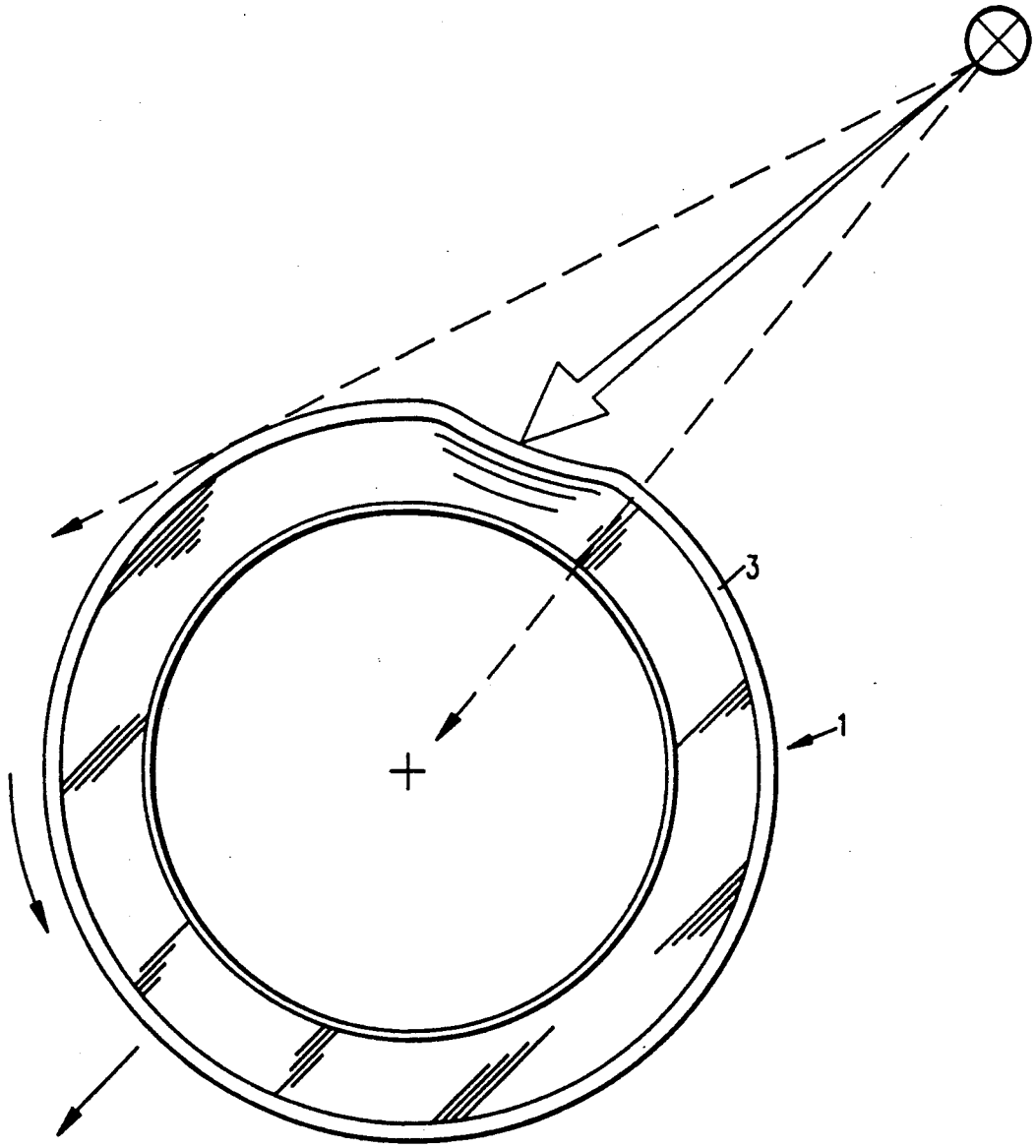
FIG. 5 shows the effect of a strike upon the periphery of the flying toy shown in FIG. 1.

FIG. 5 shows a typic 1 use of the toy 1 in which a player spins the toy 1 into the air in a counter clockwise direction and then attempts to maintain flight by repeatedly striking the toy 1. Due to its low mass and low angular momentum, the toy 1 flies slowly and due to the resilience and spring constant of the stay 2- the toy 1 remains near the player despite the player's strikes. The player then follows the toy 1 and tangentially strikes the toy 1 to maintain counter clockwise rotation. An optimum strike would be almost tangential although most real strikes lie somewhere between the desired almost tangential and the undesired radial extremes as shown in FIG. 5. Because of the resiliency and the high spring constant of the deformable circular stay 23, the radial component of the strike deforms the toy 1 rather than imparting purely linear motion to it. This elastic collision allows the toy 1 to remain near the player for the player to make another attempt at a mainly tangential strike.

Figure 6:
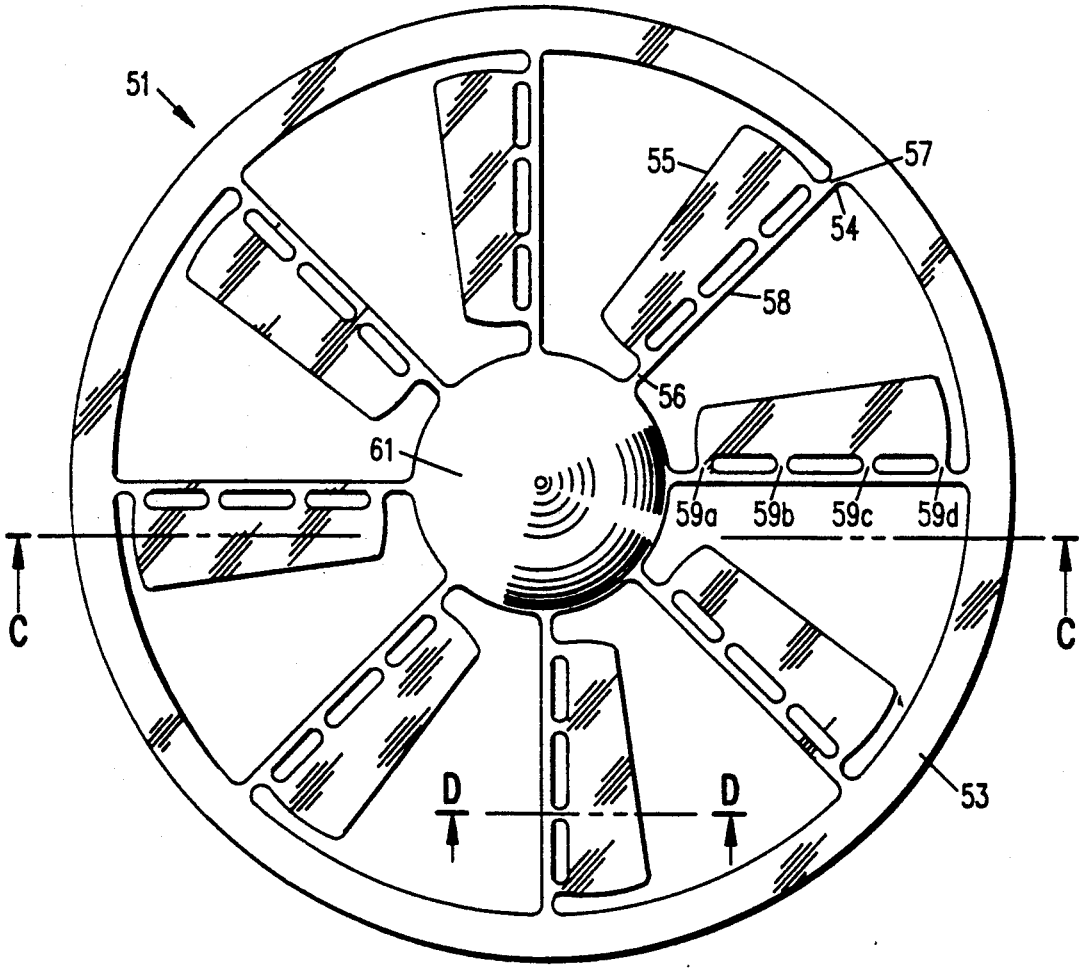
FIG. 6 shows a top view of a flying toy constructed in accordance with another preferred embodiment of the present invention.
Figure 7:
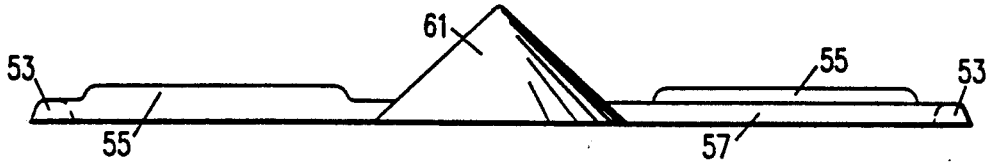
FIG. 7 shows a cross sectional view of the flying toy along lines C—C in FIG. 6.

FIGS. 6 and 7 show top and side views, respectively, of a bladed flying toy 51 that is constructed in accordance with another preferred embodiment of the present invention. A ring 53 provides stiffness for eight arms 57 mounted to a central hub 61. Each one of eight blades 55 is attached to one of the eight arms 57 from a single piece of plastic material utilizing by four hinges 59*a–d*.

The toy 51 may easily be fabricated with well known plastic vacuum forming techniques using, e.g., a durable polycarbonate such as Lexan. In the preferred embodiment, the toy 51 has a total diameter of 18 inches. The hub 61 is concave in shape and 6 inches in diameter and 3 inches tall. The ring 53 is ½ inch wide, has a half cylindrical cross section and is ¼ inch high and is attached to the arms 57 at their radially outer ends 54. The arms 57 are ¼ inch wide and ¼ inch thick and have rounded front edges 58. The hinges 59 are ½ inch long and ¼ inch wide. The dimensions of the hinges may be varied as materials of different stiffness are used. The hinges must be sufficiently flexible to allow the blades 55 to deflect up or down with the air flow yet sufficiently stiff to return the blades 55 to the central position in the absence of air flow. The hub 61 is of a sufficient thickness, e.g., 1/16 inch, to provide rigidity.

Figure 8A:
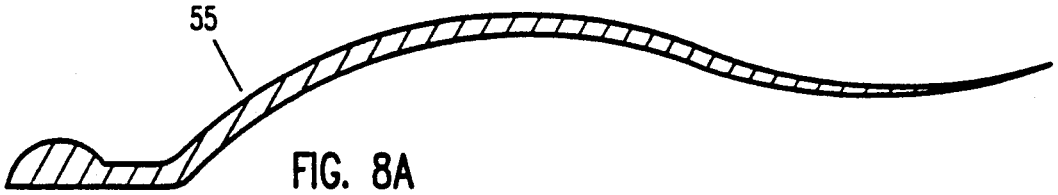
FIGS. 8A-8C depict various deflections of a blade shown in cross sectional views along lines D—D in FIG. 6.
Figure 8B:
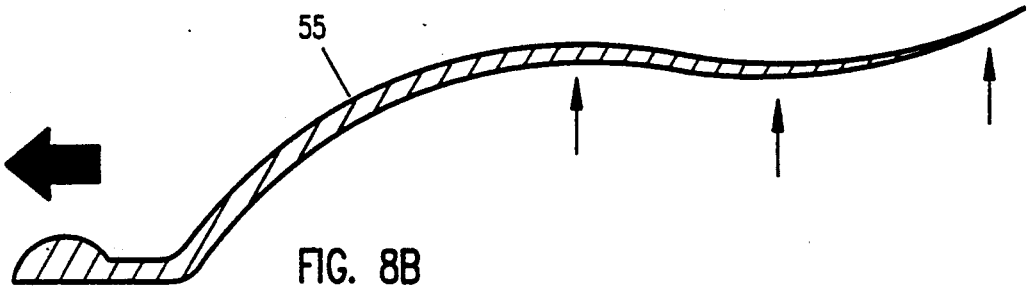
Figure 8C:
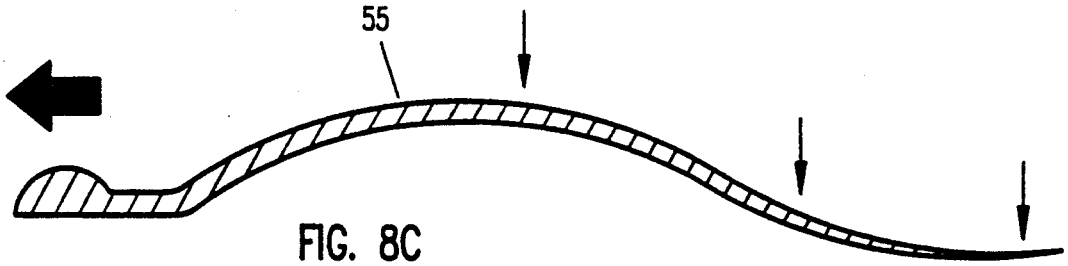

FIGS. 8A–8C show three cross sectional views of a blade 55 along lines D—D in FIG. 6. The blades 55 shown in FIG. 6 are 5¼ inches long and have a minimum width of 1 inch and a maximum width of 1¾ inch. The blades 55 are sufficiently thick, i.e., 1/16 inch thick, to avoid excessive air flow induced deformation during flight. The blades 55 may be vacuum formed to have a curved airfoil shape as shown in FIGS. 8A–8C. FIG. 8A shows a blade 55 in its central position with no vertical air flow. FIG. 8B shows the blade 55 deflected upward by downward motion of the toy 51. The upward air flow deflect the blade 55 only so far as is allowed by the stiffness of the hinges 59. The upwardly flowing air on the blade 55 both deflects the blade 55 and imparts a horizontal force on the blade 55. For the toy 51 shown in FIG. 6, this force causes clockwise rotation.

FIG. 8C shows the effect c the blade of upward motion of the toy 51. The downward relative air flow deflects the blade 55 downward. The downward air flow also causes a horizontal force on the blade 55, thereby causing clockwise rotation of the toy 51 shown in FIG. 6.

Figure 9A:
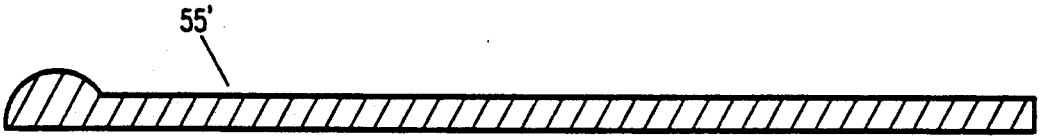
FIGS. 9A-9C depict various deflections of an alternative blade shown in cross sectional views along lines D—D in FIG. 6.
Figure 9B:
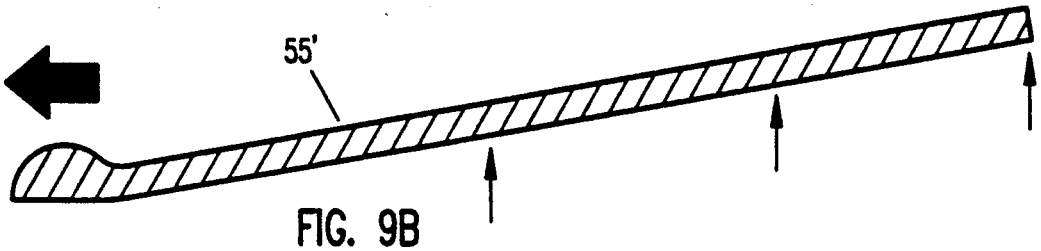
Figure 9C:
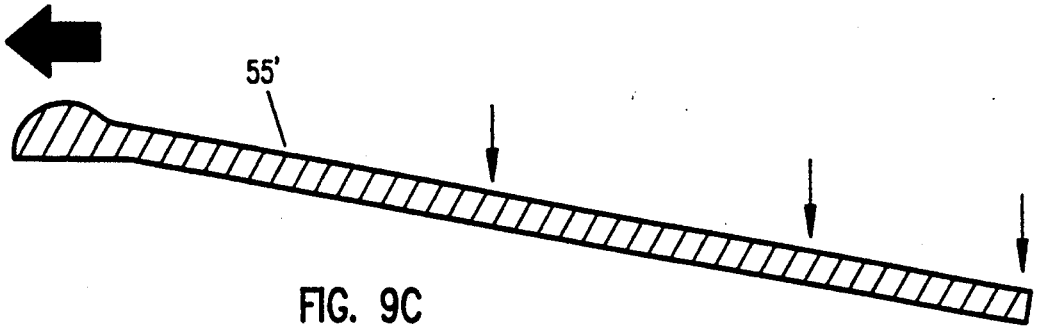

FIGS. 9A–9C show an alternative blade 55' that may be used in the toy 51 shown in FIG. 6. The alternative blade 55' is similar to blade 55 shown in FIGS. 8A–8C except that the airfoil shape is non-curved. The blade 55' is deflectable and causes clockwise rotation of the toy 51 but is less efficient than the blade 55. This alternative blade 55' is slightly easier to manufacture than is the curved blade 55.

In typical use, a player places a finger on the underside of the hub 61 and swiftly raises the toy 51 overhead until the toy 51 flies off the finger. The downward air flow against the blades 55 causes a downward deflection and a clockwise rotation of the toy 51. Upon release, the toy 51 rises to the top of its flight path and then begins to fall. As the toy 51 begins to fall, the air flow through the blades 55 reverses and causes the blades 55 to deflect upwards. This deflection continues clockwise rotation and the spinning of the toy 51 slows its fall and causes it to float downwards in an auto-gyro fashion. The slowness of the fall allows the player sufficient time to catch the toy 51 under the hub 61 and to repeat the upward throw.

In another use (not shown), a string or stick is connected to the hub 61 and is used to pump the toy 51 alternatively up and down. Since the blades 55 are deflectable, continued pumping causes the toy 51 to rotate at an ever increasing speed. When released, the toy 51 climbs and then descends slowly. In still another use, the toy 51 may be thrown or skimmed in a horizontal manner. The deflectable blades 55 maintain flight of the toy 51 while slowing its fall.

I claim:

1. A blade flying toy comprising:

a central hub;

a plurality of elongated support arm each having radially inner and outer ends disposed equidistant about the periphery of said central hub and having said radially inner ends attached to said central hub, said plurality of elongated support arms extending radially outwardly from said central hub;

an annular ring having a diameter greater than the diameter of said central hub, said annular ring disposed coaxially with said central hub and attached to said radially outer ends of said plurality of elongated support arms;

a plurality of blades; and a plurality of flexible hinge means detectably coupling each of said plurality of blades to a corresponding different one of said plurality of support arms, each of said flexible hinge means providing a no-airflow position for said blade and allowing deflection of said blade in response to an air flow past said blade, each of said flexible hinge means responsive to said airflow for providing a restoring force urging said blade towards said no-airflow position.

2. A bladed flying toy as in claim 1 wherein said central hub comprises a generally round central hub, said central hub being concave in shape.

3. A bladed flying toy as in claim 2 wherein said no-airflow position constitutes a centered position of said blade.

4. A bladed flying toy as in claim 3 wherein each said flexible hinge means comprises a predetermined length of flexible plastic.

5. A bladed flying toy as in claim 4 wherein each of said plurality of blades has a straight cross section.

6. A bladed flying toy as in claim 4 wherein each of said plurality of blades has a curved cross section.

7. A bladed flying toy as in claim 4 wherein said bladed flying toy is fabricated from a single piece of plastic.

8. A bladed flying toy comprising:

a generally round central hub, said central hub being concave in shape;

a plurality of elongated support arms each having radially inner and outer ends disposed equidistant about the peripheral of said central hub and having said radially inner ends attached to said central hub, said plurality of elongated support arms extending radially outwardly from said central hub;

an annular ring having a diameter greater than the diameter of said central hub, said annular ring disposed coaxially with said central hub and attached to said radially outer ends of said plurality of support arms, said plurality of support arms supported between said central hub and said annular ring;

a plurality of blades; and a plurality of flexible hinge means, at least one of said flexible hinge means attached to a different one of said elongated support arms and deflectably coupling a corresponding different one of said plurality of blades to a back edge thereof, each of said flexible hinge means providing a central position for said corresponding blade, each of said flexible hinge means responsive to said airflow for providing a restoring force urging said corresponding blade towards said central position.

9. A bladed flying toy as in claim 8 wherein each of said plurality of blades has a curved cross section.

10. A bladed flying toy as in claim 8 wherein each of said plurality of blades has a straight cross section.

11. A bladed flying toy as in claim 8 wherein said bladed flying toy is fabricated from a single piece of plastic.

* * * * *